US007735467B2

(12) United States Patent
Wong

(10) Patent No.: US 7,735,467 B2
(45) Date of Patent: Jun. 15, 2010

(54) ENGINE WITH PROGRESSIVE DUAL BORE ELECTRONIC THROTTLE BODY

(75) Inventor: Kevin C. Wong, Ann Arbor, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 12/255,047

(22) Filed: Oct. 21, 2008

(65) Prior Publication Data

US 2010/0095930 A1 Apr. 22, 2010

(51) Int. Cl.
*F02D 1/00* (2006.01)
*F02D 31/00* (2006.01)

(52) U.S. Cl. ..... 123/336; 123/376; 123/399; 123/400

(58) Field of Classification Search ..... 123/336, 123/337, 376, 391, 399, 400, 403
See application file for complete search history.

(56) References Cited

U.S. PATENT DOCUMENTS 5,036,816 A * 8/1991 Mann ..... 123/361
5,967,861 A * 10/1999 Ozawa et al. ..... 440/1
7,066,142 B2 * 6/2006 Hanasato ..... 123/336
7,201,141 B2 * 4/2007 Rauch et al. ..... 123/336
7,219,652 B2 * 5/2007 Ino et al. ..... 123/337
7,543,563 B2 * 6/2009 Dunn ..... 123/399
2008/0184958 A1 * 8/2008 Sato et al. ..... 123/336

* cited by examiner

*Primary Examiner*—John T Kwon

(57) ABSTRACT

An engine wherein a progressive throttle body includes two side by side throttle bores with throttle blades of equal size. A primary throttle opens from closed to an idle position with slowly increasing flow providing excellent idle and low engine speed air control. A secondary throttle opens slightly after the idle airflow position of the primary throttle and then opens more quickly, equaling the primary throttle opening near half throttle. Thereafter, the throttles open together, raising the airflow to maximum when both throttles are fully open. Both throttles are driven by a single electronically controlled motor or other actuator through two gearboxes that provide the varying flow curves. Throttle position sensors on both throttle shafts feed back throttle positions to an electronic controller to provide needed data for electronic throttle control in response to throttle commands. Additional features are disclosed.

24 Claims, 4 Drawing Sheets

ENGINE WITH PROGRESSIVE DUAL BORE ELECTRONIC THROTTLE BODY

TECHNICAL FIELD

This invention relates to engine air throttle bodies and, more particularly, to a progressive dual bore electronic throttle body that provides full range control of engine airflow.

BACKGROUND OF THE INVENTION

It is known in the art relating to engine air intake control that it is difficult to obtain maximum intake airflow for high power engine operation and close control of idle and low speed engine airflow with a throttle body having a single throttle blade controlling the full airflow range. Various solutions have been proposed which have provided varying degrees of success. An improved wide flow range throttle body was desired.

SUMMARY OF THE INVENTION

The present invention approaches the problem by providing two side-by-side throttle bores with throttle blades of identical size. A primary throttle opens from closed to an idle position with slowly increasing flow to a position providing excellent idle and low engine speed air control. A secondary throttle opens slightly after the primary throttle has already opened past the idle airflow region and then opens more quickly, equaling the primary throttle position at full rotation. Thereafter, the throttles open together but at different progressions, allowing the primary throttle only to control the idle airflow region, but at higher airflows both throttles are open. As an electronic throttle body assembly, a single motor and two throttle position sensors are conserved from the single bore requirement. Current state of the art implementations of dual bore throttle bodies utilize two separate single bore throttle bodies that each require a motor and two throttle position sensors. The present invention requires only one motor or other actuator and two throttle position sensors.

Both throttles are driven by a single electronically controlled motor or other actuator through two gearboxes that provide the varying throttle rotations. Throttle position sensors on both throttle shafts feed back throttle positions to an electronic controller to provide needed data for electronic throttle control in response to throttle commands.

These and other features and advantages of the invention may be more fully understood from the following description of an exemplary embodiment, taken together with the accompanying drawings.

DESCRIPTION OF AN EXEMPLARY EMBODIMENT

Figure 1:
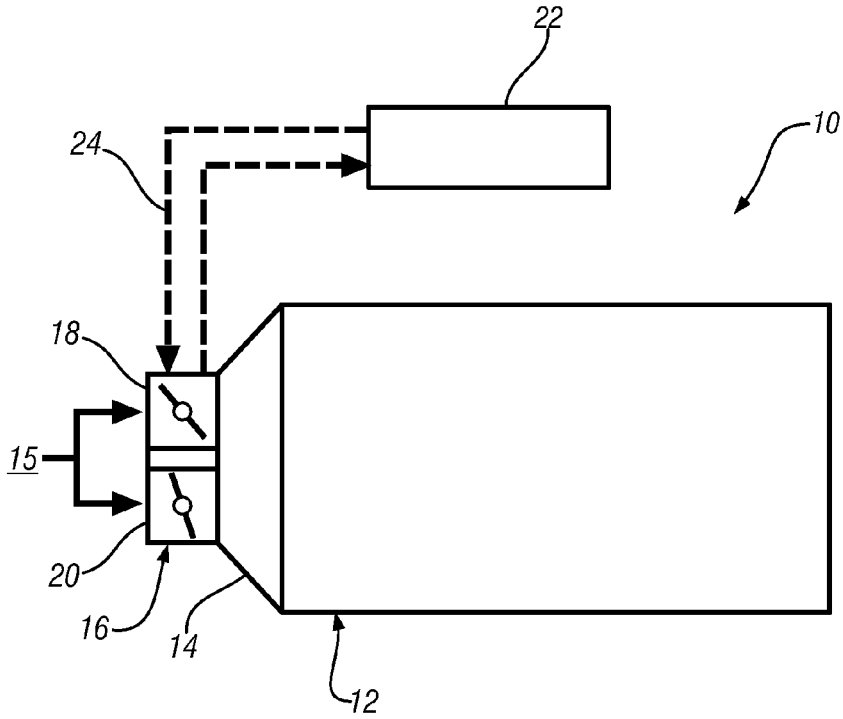
FIG. 1 is a schematic view of an engine having an intake manifold inlet with a progressive dual bore electronic throttle body according to the invention.

Referring now to FIG. 1 of the drawings in detail, numeral 10 schematically indicates an internal combustion engine, such as an automotive spark or compression ignition engine. The engine 10 has an air induction system 12 including an intake manifold 14 with a charge air inlet 15 through a progressive dual bore throttle body 16 according to the invention. The throttle body 16 controls the engine's manifold 14 pressure by throttling the intake airflow and thus it controls the acceleration and power output of the engine 10. The dual bores 18, 20 allow for large effective flow areas which are able to provide high airflows at peak engine power, but the progressive throttle opening feature of the throttle body 16 meets the requirement to maintain consistent idle speed at the lowest engine airflows. The throttle body 16 is controlled by an electronic control module 22 through wiring 24 that transfers both feedback information and motor or actuator control duty cycle.

Figure 2:
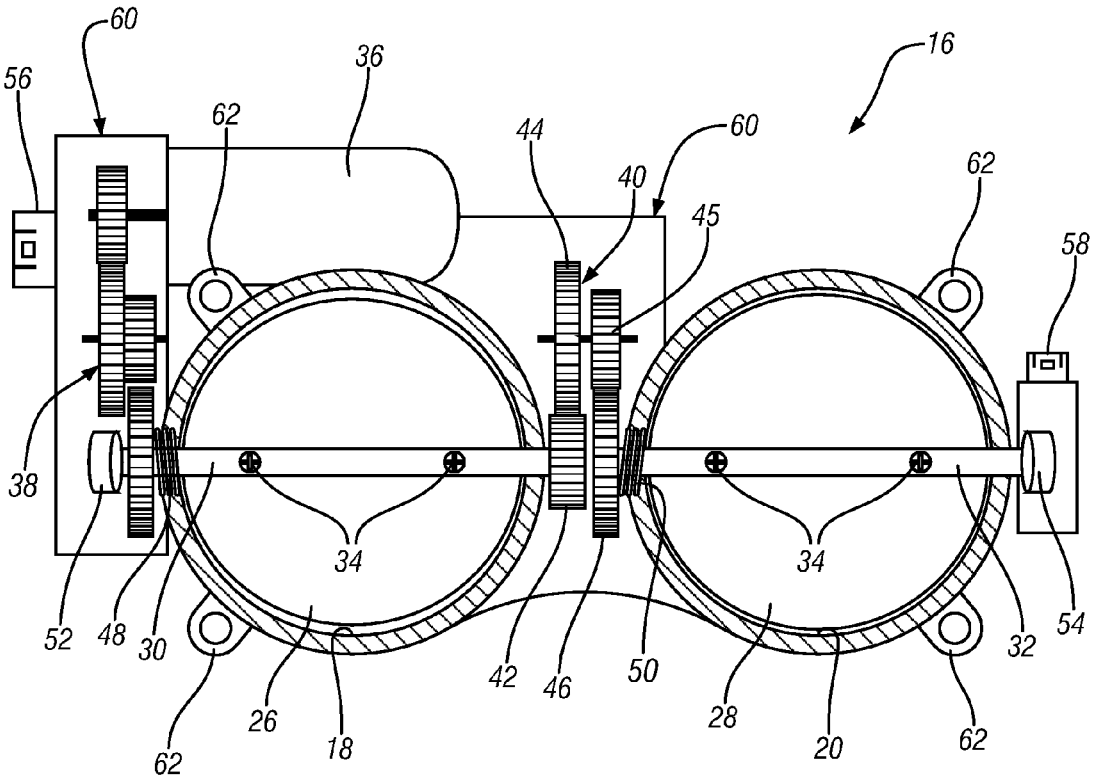
FIG. 2 is front view of a first embodiment of throttle body having the motor or actuator and gearboxes connected in series through the primary throttle shaft.
Figure 3:
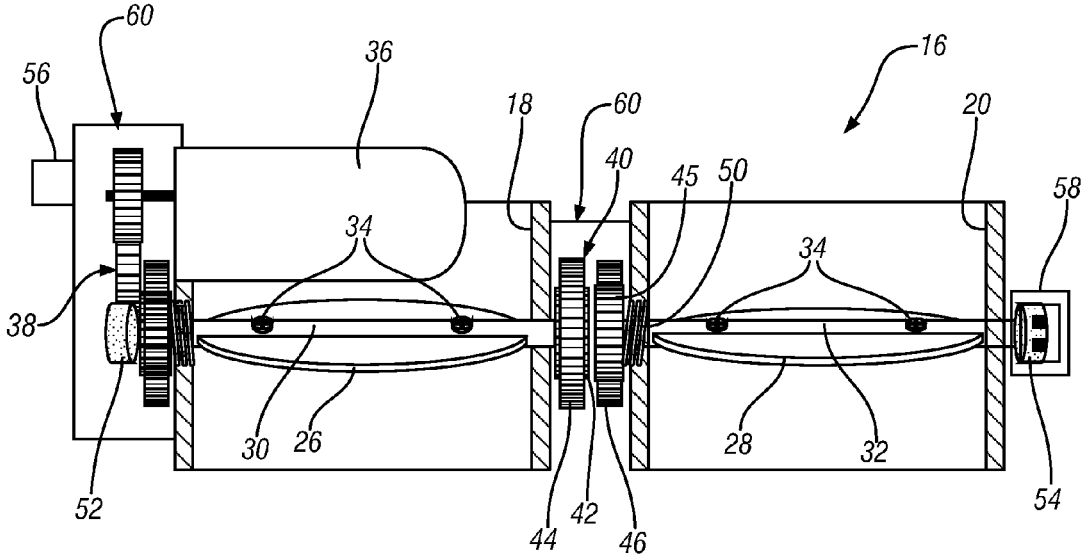
FIG. 3 is a top section view of the first embodiment of FIG. 2.

FIGS. 2 and 3 show front and top views of a first embodiment of the throttle body 16. Included are the dual throttle bores, the primary bore 18 and the secondary bore 20, having identical throttle blades 26, 28 which are attached to separate round shafts 30, 32 for the primary and secondary throttle respectively. The blades 26, 28 are secured by two screws 34 each to the shafts 30, 32. The throttle blade closing and opening of both bores is driven by a motor 36 or other actuator.

The motor 36 is connected to a primary gearbox 38, which is in turn connected directly to the primary throttle shaft 30. The main gears of gearbox 38 have physical stops, not shown, on them to keep the throttles from over or under rotating past the fully closed or open throttle positions. The primary gearbox 38 comprises a reducing gear train that establishes a fixed ratio of revolutions of the drive motor 36 to the primary throttle shaft 30. Thus, the primary throttle blade 26 rotates with the shaft 30 at the fixed ratio established by the gear train.

The other end of throttle shaft 30 is connected to a secondary progressive gearbox 40. The progressive gearbox 40 consists of a driving gear 42, connected to the primary shaft 30 and throttle blade 26, an intermediate gear 44, 45 between the driving and driven gear, and a driven gear 46 which is connected to the secondary shaft 32 and throttle blade 28. The progressive gearbox 40 is further detailed in FIGS. 4 and 5.

Each throttle has an angular motion spring 48, 50, that assists the motor 36 in both closing and opening the throttle. These springs 48, 50 each have a neutral position midway in the blade rotation and thus exert torque on the shafts 30, 32 in both the opening and closing directions of the throttle movement. There are springs 48, 50 on both sides of the progressive gearbox 40 to reduce the loads on the gears.

The primary shaft and throttle blade's rotational position is measured by an angular throttle position sensor 52 (referred to as throttle position sensor 1 or TPS1). The secondary shaft and throttle blade's rotational position is measured by an identical sensor 54 (referred to as throttle position sensor 2 or TPS2). An electrical connector 56 is provided for the primary throttle position sensor 52 and the motor 36. A second electrical connector 58 is also provided for the secondary throttle position sensor 54. The various gearboxes, sensors, throttles, shafts, and motor are all included within a housing 60, which could be plastic or metallic in nature. The composite assembly is mounted to the intake manifold or plenum by four mounting tabs 62.

Figure 4:
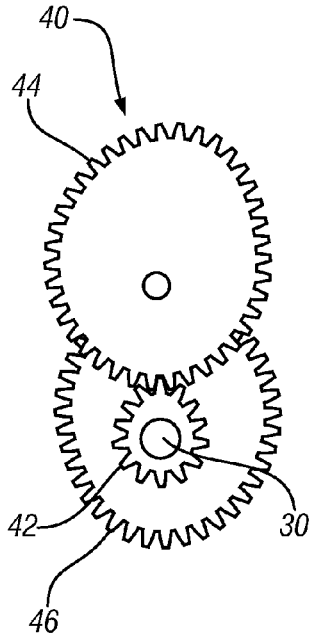
FIGS. 4 and 5 are end views from the associated throttle shafts, respectively, of elliptical gears exemplary of those for use in the secondary gearbox between the first and second throttle shafts.
Figure 5:
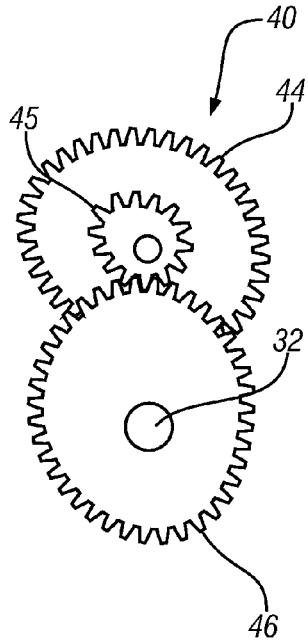

FIGS. 4 and 5 give a non-scaled example of the type of elliptical gears that would be used in the progressive secondary gearbox 40. FIG. 4 shows the gearbox as seen from the left or primary throttle side 26 as shown in the drawings while FIG. 5 views the gearbox from the right or secondary throttle side 28. All gears are non-concentric constant axis distance to allow the progressive motion between the primary and secondary throttle. The driving gear 42 is attached to the primary throttle shaft 30 and rotates the intermediate gear, which has two interfaces 44 and 45. The gears 44 and 45 make up the intermediate gear and are one piece. The intermediate gear 45 meshes with the driven gear 46 which is attached to the secondary throttle shaft 32. The intermediate gear 44, 45 is required to keep the primary and secondary throttle shafts in the same planes and parallel to each other. The geometry of the gears is defined to maintain the progressive nature of the secondary throttle opening rate as required. The progressive secondary throttle can also be achieved by various linkages and other concepts which could be an alternate implementation.

Figure 6:
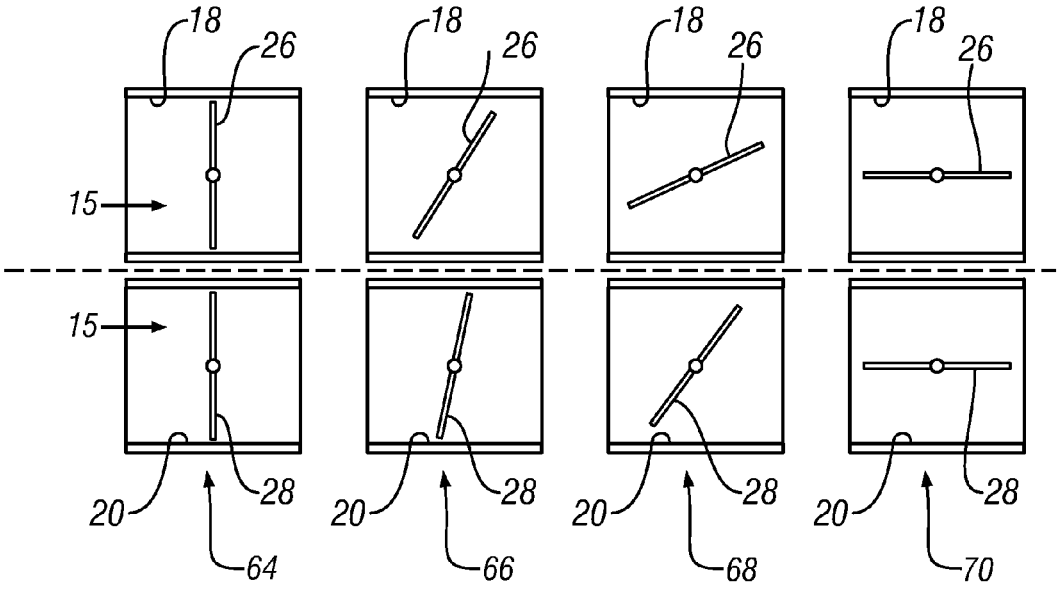
FIG. 6 is a pictorial comparison of primary and secondary throttle positions with the throttles closed, in default position, at part throttle and at wide open throttle.

FIG. 6 shows the relative throttle blade positions for several possible commanded positions. Numeral 15 indicates the airflow direction in the primary and secondary throttle bores 18, 20. At the closed throttle position 64, both throttles 26, 28 are able to fully close, which is required for maximum engine braking and also for the electronic controller to learn the minimum position of the throttle blades. At the default position 66 (motor is de-energized and the springs 48, 50 are at neutral angular force), the primary blade 26 is open to a traditional throttle default position and the secondary blade 28 is closer to being closed according to the progressive gearbox layout. Here it can be seen that when idling, between the fully closed and default positions, the primary throttle will be flowing air while the secondary throttle will be nearly closed. As the part throttle condition 68 occurs, the secondary throttle 28 starts to catch up with the primary throttle 26. At the wide open throttle position 70, both throttles 26 and 28 are fully open allowing maximum airflow through both bores 18 and 20.

Figure 7:
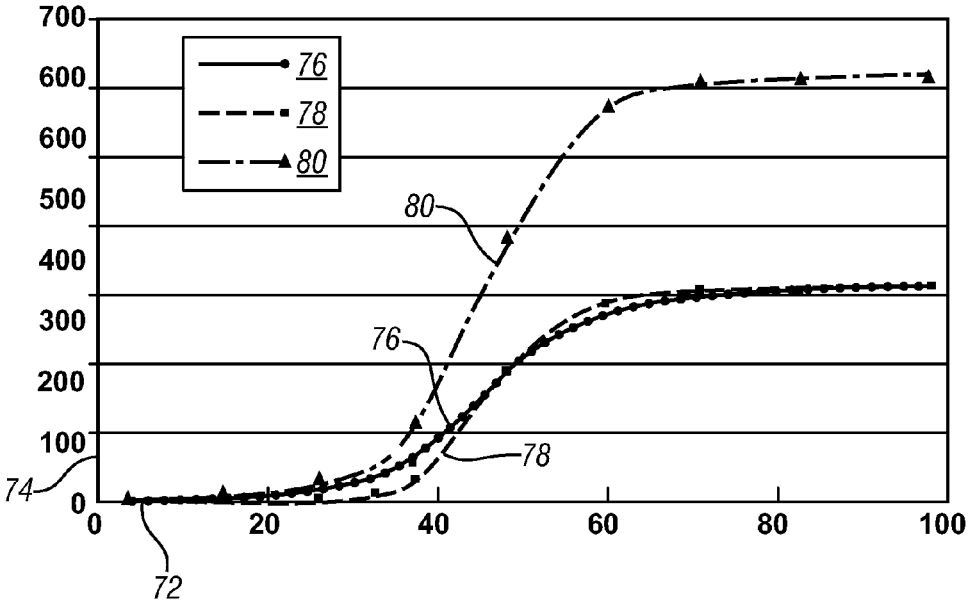
FIG. 7 is a graph of the airflow curves of the primary and secondary throttles and the sum of the two throttle's total airflow.

FIG. 7 is a graph showing dual progressive throttle body STP airflow at 80 kPa. The abcissa 72 indicates degrees of primary throttle rotation and the ordinate 74 indicates STP (standard temperature and pressure) airflow in grams/second. Curve 76 (solid line) plots the primary throttle airflow from closed to the wide open throttle position. Curve 78 (dashed line) plots the comparative secondary throttle airflow. Note that as the primary throttle opens initially the secondary throttle barely moves, a feature which contributes to the idle control capability despite having two large bores. Curve 80 (dash dot line) plots the sum of the two throttles for the total airflow of the throttle body. For about the first 30 degrees of primary throttle rotation, the secondary throttle blade 28 barely moves while the idle and low throttle airflow is controlled by the primary throttle blade 26. After the primary throttle is open about 30 degrees, the secondary throttle blade 28 begins to open quickly and catches up with the primary throttle so that both throttles are fully open at the full throttle position. The features of this invention allow for similar idle control to that of a single bore throttle body, but the airflow capability of two throttle bodies of the same bore diameter as a single bore used for idle control.

Figure 8:
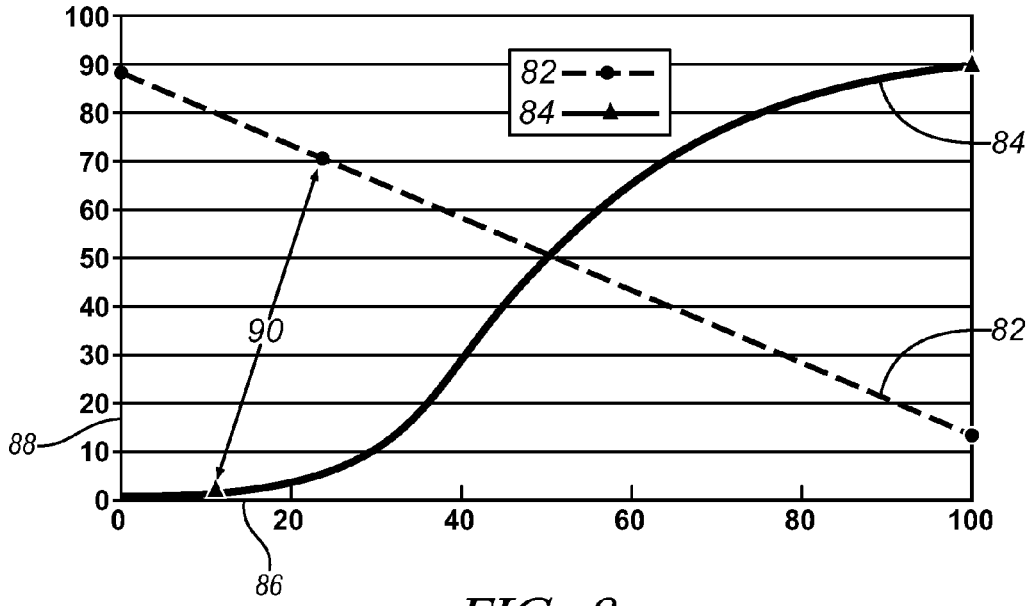
FIG. 8 graphically illustrates the raw outputs of the two throttle position sensors.

FIG. 8 graphs the output 82, 84 of the two TPS sensors TPS1 52 and TPS2 54, one each for the primary throttle 26 and secondary throttle 28. In the graph, the abcissa 86 shows the percent primary throttle rotation while the ordinate 88 indicates the percent of output. The dashed line 82 has the slope reversed for comparison with the solid line 84, which shows the secondary throttle rotation. The connecting arrows 90 indicate the default throttle positions TPS points on the lines 82, 84.

For electronic throttle control systems, security and control is paramount, and the electronic controller 22 relies on accurate information relative to the position of the throttles 26, 28, and with redundant inputs. Most current systems require two throttle position sensors that can be correlated to each other for said redundancy. The output slopes of the sensors according to current states are typically linear but having a unique slope and intercept for each throttle position sensor. In this invention, one throttle position sensor 52 measures the position of the primary throttle and this sensor provides a linear output 82 showing the rotation of the primary throttle as expected with the fixed ratio gearbox driving the primary throttle shaft. Due to the progressive gearbox, the second throttle rotates in a non-linear fashion with respect to the primary throttle, and so the secondary throttle's position sensor, despite being an identical part to the primary sensor, outputs a non-linear curve 84 according to the geometry of the progressive gearbox. The electrical slope is also reversed to provide a positively increasing trend as the throttle opens. Using an algorithm and calibrateable tables in the electronic controller, the relationship between the primary and secondary throttles in a good working system can be defined, which should match the mechanical ratio between the primary and secondary throttle shafts as provided by the progressive gearbox. With this logic, the failsafe is preserved and additional sensors do not need to be added, nor hardware input/output interfaces into the electronic controller. If a single failure mode occurs, such as a shaft failure or a progressive gearbox failure, the two TPS signals will go out of synchronism, which indicates a failure mode.

Figure 9:
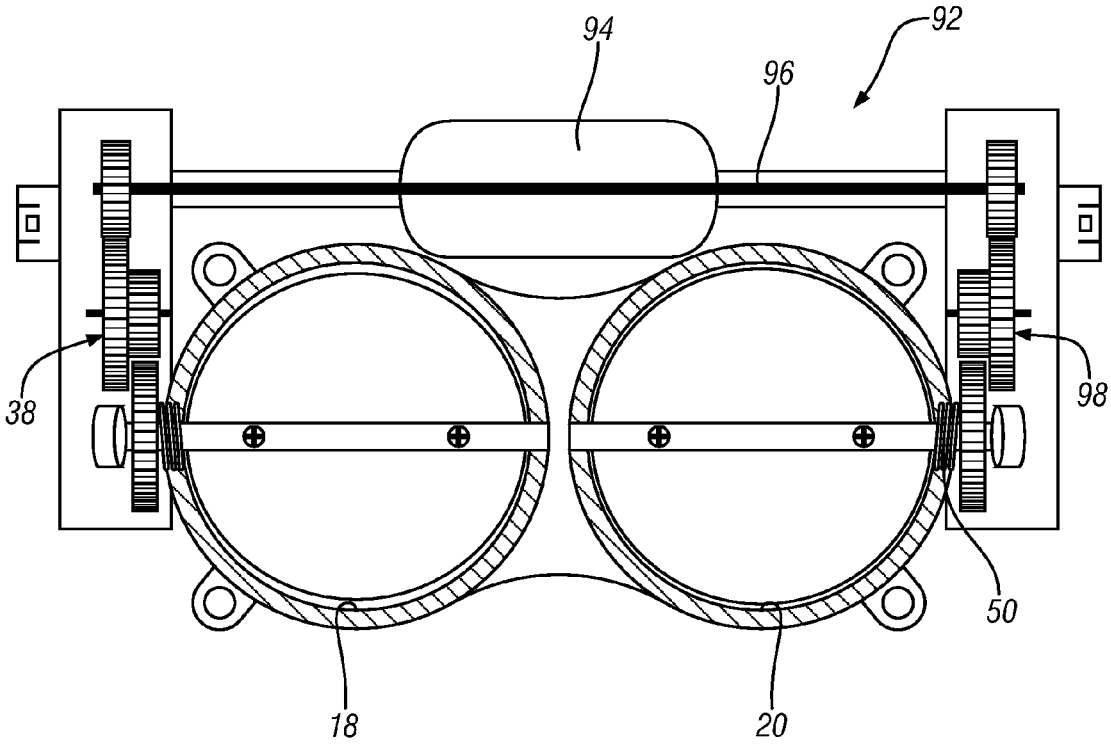
FIG. 9 is a front view showing an alternative embodiment of throttle body wherein the drive motor or actuator is separately connected to the separate gearboxes of the two throttles.

FIG. 9 details an alternative embodiment 92 of this invention that could be preferred for packaging or manufacturing reasons. Like reference numerals indicate parts like the first embodiment of FIGS. 1 and 2. This implementation is much the same except that the motor 94 or other actuator is moved into a central position between the two bores 18, 20 and is no longer offset. The motor shaft 96 is extended and exits both sides of the motor to two gearboxes. The primary gearbox 38 is the same as the offset motor embodiment, offering a fixed ratio of rotation between the drive motor 86 and the primary throttle 26. The progressive gearbox 90 offers the same progressive relationship for the secondary throttle relative to the primary throttle as the offset motor embodiment 16. In this embodiment 92, the secondary throttle spring 50 is moved to the outboard side near the progressive gearbox 98. Reference numerals not shown in FIG. 10 are the same as those of corresponding elements illustrated and described relative to the embodiment of FIGS. 2 and 3.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. An internal combustion engine comprising:

an air induction system for admitting combustion air into the engine;

a throttle body mounted for controlling airflow into the induction system, the throttle body including;

primary and secondary throttle bores opening into an air intake of the system;

primary and secondary throttle shafts carrying primary and secondary throttle blades (throttles) in the primary and secondary throttle bores, respectively, the shafts being operative to actuate their respective throttles between closed and open positions;

a single motor comprising the sole power actuator operatively connected for actuating the throttles;

a primary gear train connected between the actuator and the primary throttle shaft for actuating the primary throttle;

a secondary gear train connected between the actuator and the secondary throttle shaft for actuating the secondary throttle;

wherein the primary gear train establishes a first angular relation between rotation of the primary throttle and the actuator;

the secondary gear train establishes a second angular relation between rotation of the secondary throttle and the actuator; and the secondary gear train establishes a progressive angular rate of rotation between the secondary throttle and the actuator.

2. An internal combustion engine as in claim 1 wherein the primary and secondary gear trains are both connected directly to the actuator.

3. An internal combustion engine as in claim 1 including an electronic controller connected to operate the actuator in accordance with an operation program and in response to received input data.

4. An internal combustion engine as in claim 3 including throttle position sensors connected to sense the positions of the primary and secondary throttle shafts and feed back position data to the controller.

5. An internal combustion engine as in claim 1 wherein the primary and secondary throttle bores are of substantially equal diameter, as are the primary and secondary throttles.

6. An internal combustion engine as in claim 1 wherein the throttle opening of the secondary throttle is negligible in the idle engine speed range and increases rapidly thereafter to about mid throttle, thereafter approximately tracking the opening of the primary throttle.

7. An internal combustion engine as in claim 1 wherein the engine includes an intake manifold and the throttle body is mounted at an inlet of the intake manifold.

8. An internal combustion engine comprising:

an air induction system for admitting combustion air into the engine;

a throttle body mounted for controlling airflow into the induction system, the throttle body including;

primary and secondary throttle bores opening into an air intake of the system;

primary and secondary throttle shafts carrying primary and secondary throttle blades (throttles) in the primary and secondary throttle bores, respectively, the shafts being operative to actuate their respective throttles between closed and open positions;

a single motor comprising the sole power actuator operatively connected for actuating the throttles;

a primary gear train connected between the actuator and the primary throttle shaft for actuating the primary throttle;

a secondary gear train connected between the actuator and the secondary throttle shaft for actuating the secondary throttle;

wherein the primary gear train establishes a first angular relation between rotation of the primary throttle and the actuator;

the secondary gear train establishes a second angular relation between rotation of the secondary throttle and the actuator; and the primary gear train is connected directly to the actuator and the secondary gear train is connected directly to the primary throttle shaft and is thereby connected to the actuator.

9. An internal combustion engine as in claim 8 including an electronic controller connected to operate the actuator in accordance with an operation program and in response to received input data.

10. An internal combustion engine as in claim 9 including throttle position sensors connected to sense the positions of the primary and secondary throttle shafts and feed back position data to the controller.

11. An internal combustion engine as in claim 8 wherein the primary and secondary throttle bores are of substantially equal diameter, as are the primary and secondary throttles.

12. An internal combustion engine as in claim 8 wherein the throttle opening of the secondary throttle is negligible in the idle engine speed range and increases rapidly thereafter to about mid throttle, thereafter approximately tracking the opening of the primary throttle.

13. An internal combustion engine as in claim 8 wherein the engine includes an intake manifold and the throttle body is mounted at an inlet of the intake manifold.

14. A throttle body mounted for controlling airflow into an intake manifold of an internal combustion engine, the throttle body including:

primary and secondary throttle bores opening into an air intake of the manifold;

primary and secondary throttle shafts carrying primary and secondary throttle blades (throttles) in the primary and secondary throttle bores, respectively, the shafts being operative to actuate their respective throttles between closed and open positions;

a single motor comprising the sole power actuator operatively connected for actuating the throttles;

a primary gear train connected between the actuator and the primary throttle shaft for actuating the primary throttle;

a secondary gear train connected between the actuator and the secondary throttle shaft for actuating the secondary throttle;

wherein the primary gear train establishes a first angular relation between rotation of the primary throttle and the actuator;

the secondary gear train establishes a second angular relation between rotation of the secondary throttle and the actuator; and the secondary gear train establishes a progressive angular rate of rotation between the secondary throttle and the actuator.

15. A throttle body as in claim 14 wherein the primary and secondary gear trains are both connected directly to the actuator.

16. A throttle body as in claim 14 including an electronic controller connected to operate the actuator in accordance with an operation program and in response to received input data.

17. A throttle body as in claim 16 including throttle position sensors connected to sense the positions of the primary and secondary throttle shafts and feed back position data to the controller.

18. A throttle body as in claim 14 wherein the primary and secondary throttle bores are of substantially equal diameter, as are the primary and secondary throttles.

19. A throttle body as in claim 14 wherein the throttle opening of the secondary throttle is negligible in the idle engine speed range and increases rapidly thereafter to about mid throttle, thereafter approximately tracking the opening of the primary throttle.

20. A throttle body mounted for controlling airflow into an intake manifold of an internal combustion engine, the throttle body including:

primary and secondary throttle bores opening into an air intake of the manifold;

primary and secondary throttle shafts carrying primary and secondary throttle blades (throttles) in the primary and secondary throttle bores, respectively, the shafts being operative to actuate their respective throttles between closed and open positions;

a single motor comprising the sole power actuator operatively connected for actuating the throttles;

a primary gear train connected between the actuator and the primary throttle shaft for actuating the primary throttle;

a secondary gear train connected between the actuator and the secondary throttle shaft for actuating the secondary throttle;

wherein the primary gear train establishes a first angular relation between rotation of the primary throttle and the actuator;

the secondary gear train establishes a second angular relation between rotation of the secondary throttle and the actuator; and the primary gear train is connected directly to the actuator and the secondary gear train is connected directly to the primary throttle shaft and is thereby connected to the actuator.

21. A throttle body as in claim 20 including an electronic controller connected to operate the actuator in accordance with an operation program and in response to received input data.

22. A throttle body as in claim 21 including throttle position sensors connected to sense the positions of the primary and secondary throttle shafts and feed back position data to the controller.

23. A throttle body as in claim 20 wherein the primary and secondary throttle bores are of substantially equal diameter, as are the primary and secondary throttles.

24. A throttle body as in claim 20 wherein the throttle opening of the secondary throttle is negligible in the idle engine speed range and increases rapidly thereafter to about mid throttle, thereafter approximately tracking the opening of the primary throttle.

* * * * *